United States Patent [19]

Lumpkin

[11] Patent Number: 4,635,943

[45] Date of Patent: Jan. 13, 1987

[54] INDOOR AND OUTDOOR GAME

[76] Inventor: Larry Lumpkin, 22822 Palm Ave., Apt. 28, Grand Terrace, Calif. 92324

[21] Appl. No.: 820,796

[22] Filed: Jan. 22, 1986

[51] Int. Cl.[4] ..... A63B 67/06

[52] U.S. Cl. ..... 273/402; 273/354; 273/389; 273/424

[58] Field of Search ..... 273/398–402, 273/424, 425, 407, 1.5 R, 389, 354

[56] References Cited

U.S. PATENT DOCUMENTS

| | | | |
|---|---|---|---|
| 1,258,931 | 3/1918 | Newcombe | 273/402 |
| 2,926,914 | 3/1960 | Miller | 273/389 X |
| 4,079,939 | 3/1978 | Raistakka | 273/402 |
| 4,153,252 | 5/1979 | Sullivan | 273/424 |
| 4,160,549 | 7/1979 | Simpson | 273/402 X |
| 4,168,066 | 9/1979 | Sole et al. | 273/402 |
| 4,266,764 | 5/1981 | Collins | 273/354 X |
| 4,373,734 | 2/1983 | Frank | 273/401 X |

FOREIGN PATENT DOCUMENTS

| | | | |
|---|---|---|---|
| 1341549 | 9/1963 | France | 273/1.5 R |
| 520656 | 10/1939 | United Kingdom | 273/1.5 R |

OTHER PUBLICATIONS

The Sporting Goods Dealer, 5-1972, p. 114, Frisbee Horseshoes.

*Primary Examiner*—Paul E. Shapiro

[57] ABSTRACT

This indoor and outdoor game is designed to be played by one person or may be competitively played by from two to four players. Primarily, it consists of a plurality of saucer shaped plastic discs that are tossed at an opponent's hoop to be received therein, for scoring points. A stand is provided for supporting poles attached to the hoops, and a net is attached to each hoop at the top, for engaging with the discs as they pass through.

1 Claim, 7 Drawing Figures

FIG. 1
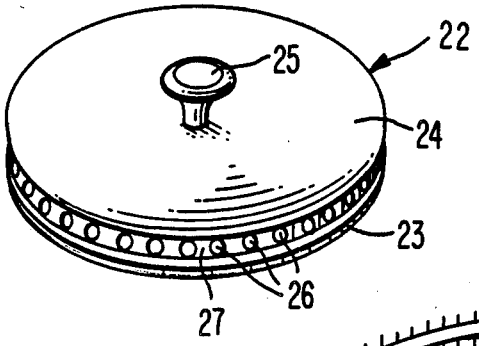
FIG. 2
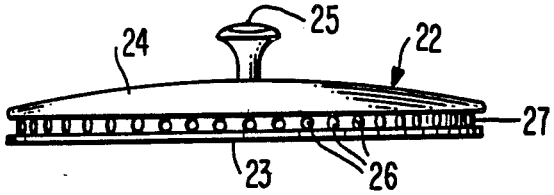
FIG. 3
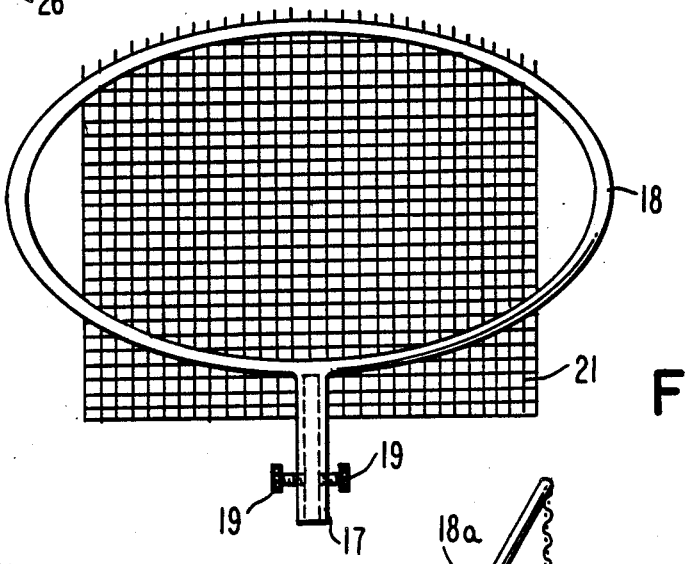
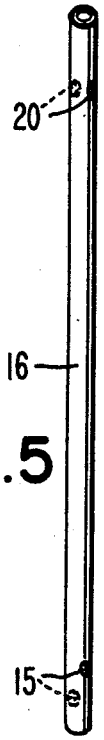
FIG. 5
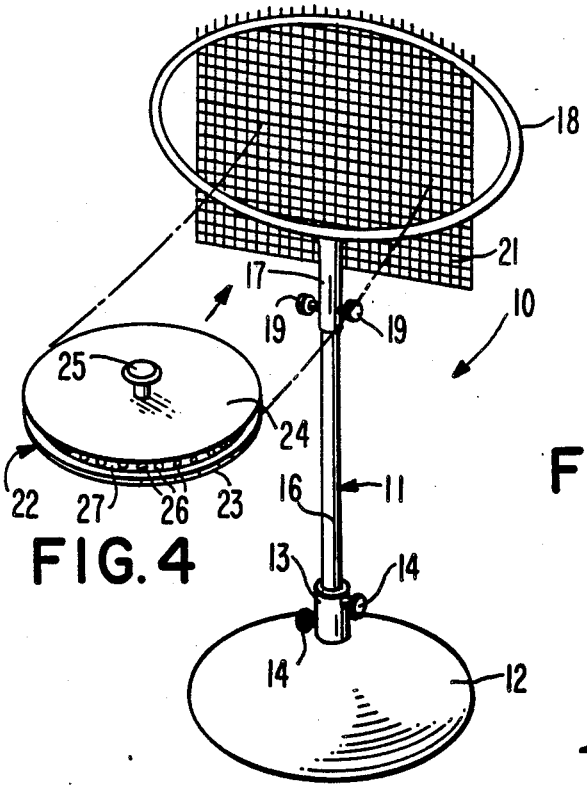
FIG. 4
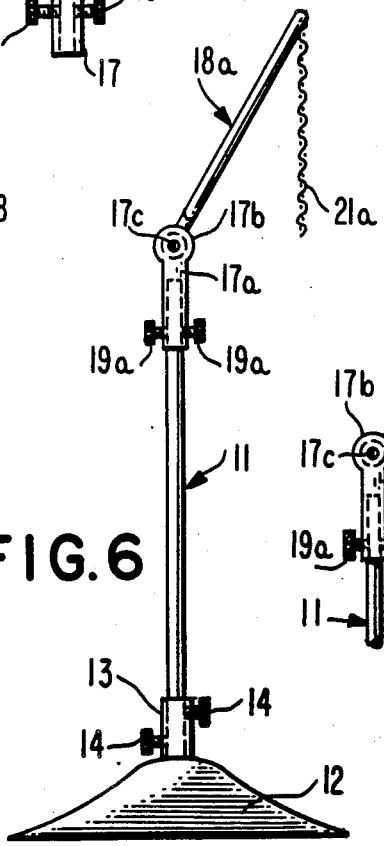
FIG. 6
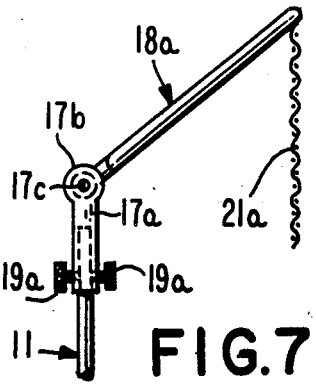
FIG. 7

INDOOR AND OUTDOOR GAME

BACKGROUND OF THE INVENTION

1. Field of the Invention

This invention relates to games of skill, and more particularly, to an indoor and outdoor game.

2. Description of Prior Art

Competitive games have been devised and are of many varieties. The game in accordance with the present invention, is designed to be novel and fast moving, and employs a disc of plastic that is to be placed in a hoop containing a net.

The principal object of this invention is to provide an indoor and outdoor game that will be unique and novel, and may be played competitively.

Another object of this invention is to provide an indoor and outdoor game, which will include a saucer shaped disc as a playing piece, which will be employed in plurality for playing the game with two or four players, or it may be played by one person, if desired.

A further object of this invention is to provide an indoor and outdoor game, which will employ a hoop with a net therein, for the discs to be tossed or soared into.

BRIEF DESCRIPTION OF THE DRAWINGS

FIG. 1 is a perspective view of a disc employed in playing the present invention;

FIG. 2 is a side elevational view of FIG. 1;

FIG. 3 is a front elevational view of the loop and net combination employed in playing the game;

FIG. 4 is a perspective view of the present invention, illustrating the disc being tossed;

FIG. 5 is a perspective view of the pole of the stand, shown removed from the assembly;

FIG. 6 is a side elevational view of a modified stand, and

FIG. 7 is similar to FIG. 6, but is shown fragmentary and illustrates the hoop portion at a different angle.

SUMMARY OF THE INVENTION

An indoor and outdoor game, comprising a disc which is employed in plurality and are tossed into a hoop and net combination on a stand, for scoring purposes.

DETAILED DESCRIPTION

Accordingly, a game 10 is shown to include a stand 11 which is composed of a base 12, having one end of a sleeve 13 fixedly secured to its top center. A pair of set screws 14 are received in openings 15 through the bottom portion of pole, and provides the means for securing base 12 to pole 16. A second sleeve 17 is fixedly secured to the outer periphery of an oval shaped hoop

18, and a pair of set screws 19 are received in openings 20 at the top portion of pole 16, for rendering sleeve 17 and hoop 18 secure to pole 16. A net 21 of suitable fabric such as, cotton, is fixedly secured to the top portion of hoop 18, and is rectangular in configuration. A disc 22 of a firm but flexible plastic, includes a bottom portion 23 and a top portion 24 which is convex in shape, and is provided with a knob 25 at its center, which is fixedly secured thereto. A plurality of equally and radially spaced openings 26 are provided within an annular groove 27, so as to create a whistling sound when disc 22 is tossed, and a complete set of discs 22 will be eight in number, and four will be of the same color or design. The number of stands 11 will be two, and it shall be noted, that the base 12 must be fabricated of a suitable material that will weigh at least five pounds, for stability. The stands 11 will preferably be four and a half feet in height.

In use, the stands 11 will be positioned twenty to twenty-five feet apart in front of the players, and the object is to attempt to toss a disc 22 through the opponent's netted hoop 18. One point is scored if a player only manages to hit a pole 16. Two points are scored if a player hits the hoop 18, but the disc 22 does not go through the nets 21. Five points are scored when a player tosses a disc 22 through the netted hoop 18, and the persons playing may decide how many points must be scored to win.

Referring now to FIGS. 6 and 7, a modified hoop **18*a* having a net 21*a* similar to 21 described, is shown to include a sleeve 17*a* which is mounted to pole 16 by set screws 19*a*, and hoop 18*a* also includes a net 21*a* fastened to its top. The top portion of sleeve 17*a* is provided with an eye portion 17*b* which receives a screw 17*c* that enables the angle of hoop 18*a* to be adjusted, so as to enable game 10** to be played on more difficult skill levels.

In use, modified hoop **18*a* functions in the same manner described of hoop 18, with the exception, that it is adjustable in angle by means of screw 17*c***.

While various changes may be made in the detail construction, such changes will be within the spirit and scope of the present invention, as defined by the appended claims.

What I now claim is:

1. An Indoor and Outdoor game comprising:

(a) a stand, said stand comprising a base, a pole secured to said base and extending upwardly therefrom, a target hoop mounted to the top of said pole, and means securing said hoop at a lowermost portion thereof to said pole for adjustably tilting said hoop about a generally horizontal axis, and (b) a disc for throwing through said hoop.

* * * * *